United States Patent [19]

Andrews

[11] 4,248,387

[45] Feb. 3, 1981

[54] METHOD AND APPARATUS FOR COMMINUTING MATERIAL IN A RE-ENTRANT CIRCULATING STREAM MILL

[75] Inventor: Norwood H. Andrews, Moorestown, N.J.

[73] Assignee: Norandy, Inc., Moorestown, N.J.

[21] Appl. No.: 37,253

[22] Filed: May 9, 1979

[51] Int. Cl.[3] ..... B02C 19/06

[52] U.S. Cl. ..... 241/5; 241/39

[58] Field of Search ..... 241/39, 40, 5, 18

[56] References Cited

U.S. PATENT DOCUMENTS

| | | | |
|---|---|---|---|
| 3,688,991 | 9/1972 | Andrews | 241/5 |
| 4,018,388 | 4/1977 | Andrews | 241/39 |

*Primary Examiner*—Mark Rosenbaum

*Attorney, Agent, or Firm*—Seidel, Gonda, Goldhammer & Panitch

[57] ABSTRACT

A re-entrant circulating stream mill vents a part of the circulating stream adjacent the annular peripheral wall of the mill directly to the junction in each of a plurality of sets of pressure nozzles and cooperating acceleration tubes which are used to form the circulating stream. Each pressure nozzle provides a high velocity gaseous jet stream that entrains material as it enters the acceleration tube where the material is accelerated to its maximum velocity before it is discharged into the vortex chamber of the mill and impacts upon the circulating stream adjacent the annular peripheral wall of the vortex chamber. The apparatus also takes advantage of the comminution of the material which takes place in the acceleration tube.

14 Claims, 6 Drawing Figures

122
160
162
100
130
118
112
114
120
124
150
154
116
136
134
138
144
146
148
6
6

146
148
142
136
138
140

METHOD AND APPARATUS FOR COMMINUTING MATERIAL IN A RE-ENTRANT CIRCULATING STREAM MILL

BACKGROUND OF THE INVENTION

The present invention relates to a comminuting apparatus and method, and more particularly to comminution in a mill of the re-entrant circulating stream type commonly referred to as a "Micronizer". The Micronizer is the oldest and most widely used of the re-entrant circulating stream grinding mills, and is described in detail in U.S. Pat. No. 2,032,827 issued Mar. 3, 1936. The basic mill includes a vortex chamber comprising an annular peripheral wall closed by two opposed lateral walls. In its preferred form, the vortex chamber is formed so that the axial length of the peripheral wall is only a small fraction of the diameter of the chamber. The peripheral wall is surrounded by a manifold through which high pressure gas is supplied to a plurality of spaced gaseous fluid nozzles angled so that the gaseous jet streams issuing from them create and propel the fluid circulating in the vortex with both a forward and a radial component of movement relative to the axis of the chamber. The material to be comminuted is usually fed into the chamber by a gaseous nozzle and venturi apparatus at a location near the periphery of the chamber. The action of the mill creates a self-classifying effect so that the finished product can be removed through an outlet located at or near the central axis of the mill.

As pointed out in U.S. Pat. No. 2,032,827 and similarly in U.S. Pat. No. 4,018,388, the gaseous jet stream issuing from the nozzles performs two functions. First, it creates a high velocity circulating stream of gaseous fluid and material within the vortex chamber. This circulating stream functions to classify the material by carrying the lighter fractions of material to the central outlet while the heavier particles circulate adjacent to the peripheral wall due to centrifugal force. The second function of the gaseous jet stream issuing from the nozzles is to impart a transverse or radial component of movement to the particles of material thereby causing them to collide with the circulating particles with sufficient force to comminute the material. Accordingly, the relationship between the circulating stream of material and gas and the gaseous jet stream issuing from the nozzles has a significant effect upon the operation of re-entrant circulating stream type comminuting apparatus. U.S. Pat. No. 4,018,388 describes how the introduction of feed material has a loading effect upon the whirling vortex and hence directly effects the comminuting process in a Micronizer type mill. See also copending patent application Ser. No. 904,665 filed May 10, 1978 for comminuting and classifying apparatus of the re-entrant circulating stream jet type, now U.S. Pat. No. 4,189,102. Also, the velocity of particles diverted by the gaseous jet stream significantly affects the comminuting process since momentum is proportional to the square of the velocity. Therefore, the design of the nozzles is important to the operation of the mill.

Heretofore, it has been the commercial practice in re-entrant circulating stream type mills to position the nozzles in the peripheral wall of the vortex chamber so that the gaseous jet stream issuing from them entrains the material circulating adjacent the inner surface of the wall and projects it through the circulating stream of gaseous fluid and material. It is known that the material load in the circulating stream must have some radial depth or else material accelerated by the gaseous jet stream will have little opportunity for impact at its maximum velocity. Thus, the radial depth of the circulating material must be greater than the distance it takes the gaseous jet stream to accelerate the material to its maximum velocity. In any event, maximum velocity will occur after the jet stream has passed through the coarsest material adjacent the inner periphery of the mill. This explains the often observed and published fact that reducing the feed rate (while maintaining other factors constant) increases the fineness until the circulating load becomes of such slight radial extent that further reduction of the feed rate no longer increases fineness.

Most Micronizer type mills use nozzles of uniform cross-sectional area, frequently called abrupt type nozzles. It has been explained in various technical papers that under most operating conditions such nozzles are advantageous over converging-diverging nozzles. The advantage of a nozzle having a bore of uniform cross-sectional area (hereinafter referred to as a tubular nozzle) is that the final expansion of the gaseous jet stream occurs beyond the nozzle causes a suction at its exit end thereby increasing the entraining ability of the gaseous jet stream issuing from the nozzle. Notwithstanding this, the maximum velocity of entrained material does not occur at the exit of the nozzle because of the time it takes to accelerate the material. Yet it is at or closely adjacent to the wall where a large percentage of the larger particles of material are circulating.

Converging-diverging nozzles would appear to be a useful alternative to tubular nozzles because of their ability to generate extremely high velocity gaseous streams. There may be no more concentrated release of energy, except in explosives, than can be obtained from the discharge of a gas at the exit of a nozzle, and converging-diverging nozzles can produce supersonic velocities. The problem with such nozzles in Micronizers is that it is difficult to entrain material into the gaseous streams because expansion takes place in the nozzle. For that reason, tubular nozzles have almost uniformly been used in Micronizers even though they cannot generate gaseous velocities equal to those produced by converging-diverging nozzles.

In order to take advantage of the high velocities generated by converging-diverging nozzles, there have been attempts to configure the peripheral wall, mostly in the form of a "V" or trapezoid, to try to force circulating material into the gaseous jet stream issuing from the converging-diverging nozzles. However, it has been found that any improvement in comminuting is not due to the shape of the peripheral wall as much as to axially restricting the circulating load and hence radially extending it. Because the gaseous stream issuing from a convergent-divergent nozzle becomes turbulent a short distance from its exit, it finally self-loads with material in a manner similar to the way a tubular nozzle aspirates the material. However, no benefit is obtained from the high, even supersonic velocity of the gaseous material issuing from a converging-diverging nozzle.

Another approach is to operate a Micronizer using steam at extremely high pressures and temperatures. So that the Micronizer uses the same quantity of steam, the nozzles are drilled with much smaller diameter bores. Tests were made on 12, 15 and 20-inch diameter Micronizers at pressures up to 1400 lbs. p.s.i. gauge and 900°

F. The results were inferior to what is normally obtained in the same size mills at 175 to 200 lbs. p.s.i. gauge and 700° F. The reason is that the gaseous jet stream issuing from the nozzle is so dense and small in diameter that it literally punches through the circulating stream without entraining material. Still further, there is no room for material to enter the gaseous stream as it exits from the nozzle.

From the foregoing, it should be apparent that the problem is to provide a nozzle structure which will accelerate the vented material to the highest possible velocity and still effectively cause the accelerated material to collide with the circulating material.

SUMMARY OF THE INVENTION

The present invention is concerned with a method and apparatus for comminuting material in a re-entrant circulating stream mill. More particularly, the present invention provides a method and apparatus for more effective acceleration of the vented material to higher velocities for improved comminution.

In accordance with the present invention, a re-entrant circulating stream comminuting mill is provided with a plurality of gaseous pressure nozzles which are positioned outside of and radially remote from the annular peripheral wall of the mill. Each nozzle, such as a converging-diverging nozzle for accelerating gaseous fluid to a high velocity, is positioned to discharge the high energy fluid into the open end of an aligned accelerating tube of generally uniform cross-sectional area throughout its length for accelerating vented material and directed it into the mill vortex chamber with the requisite forward and radial component of movement to form and maintain a fluid vortex within the chamber. A transfer tube provides communication between the inner peripheral wall to a space between the end of the gaseous pressure nozzle and the entrance to the accelerating tube so that material circulating along the peripheral wall is aspirated through the transfer tube and into the acceleration tube where it reaches the highest possible velocity before it intersects with material circulating along the peripheral wall of the vortex chamber.

Stated otherwise, circulating material in the mill is removed and then immediately accelerated to its maximum velocity remote from the inner surface of the peripheral wall so as to be maximumly effective when the material re-enters the vortex chamber.

Accordingly, the present invention provides an apparatus and method by which jets of gaseous fluid, regardless of type or pressure, can be loaded to their maximum effective material carrying capacity before entering the mill at the inner surface of the peripheral wall. Moreover, apparatus of this type takes advantage of the fact that comminution actually takes place within the acceleration tubes.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

DETAILED DESCRIPTION

Figure 1:
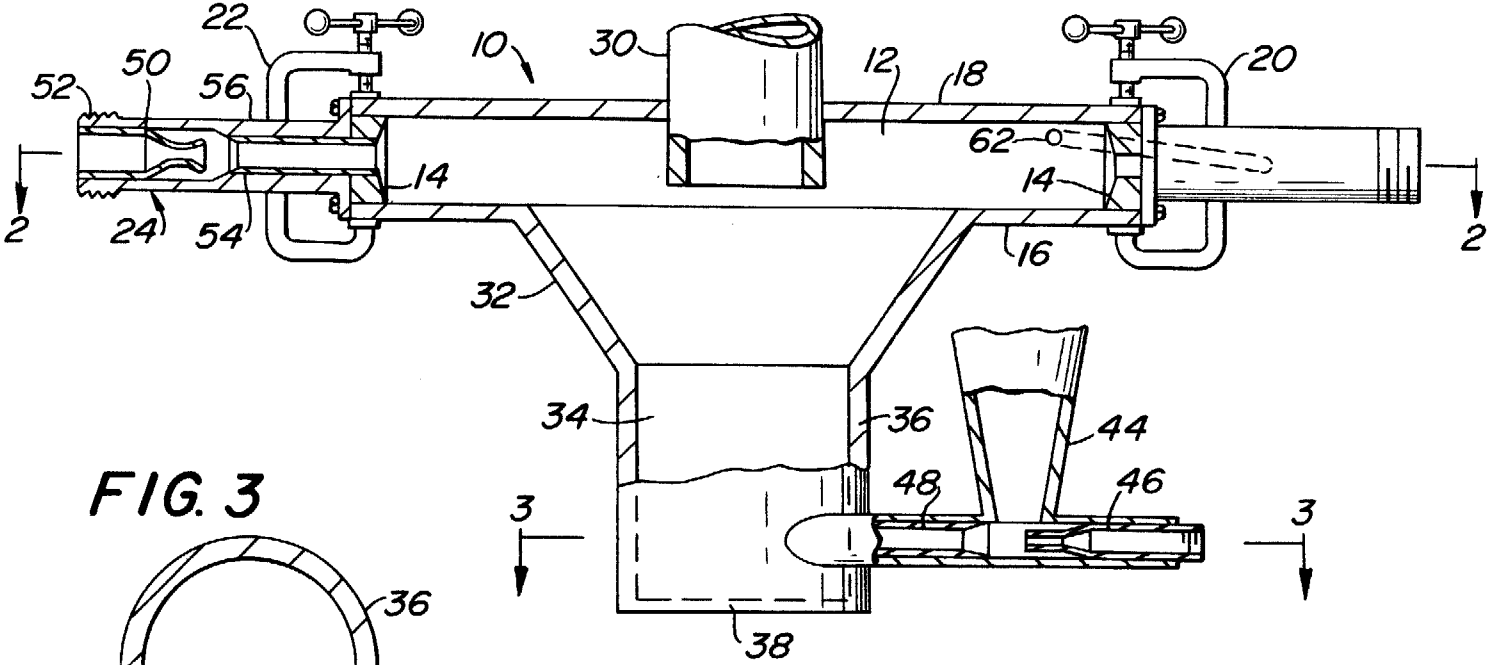
FIG. 1 is a sectional view of a mill embodying the present invention.

Referring to the drawings in detail, wherein like numerals indicate like elements, there is shown in FIG. 1 a comminuting mill of the re-entrant circulating stream type designated generally as 10. The mill 10 includes a circular vortex or comminuting chamber 12 defined by the annular peripheral wall 14 and the opposed lateral walls 16 and 18. The walls 14, 16 and 18 are removably held together by C-clamps 20 and 22 so that the apparatus 10 may be readily disassembled and cleaned.

Figure 2:
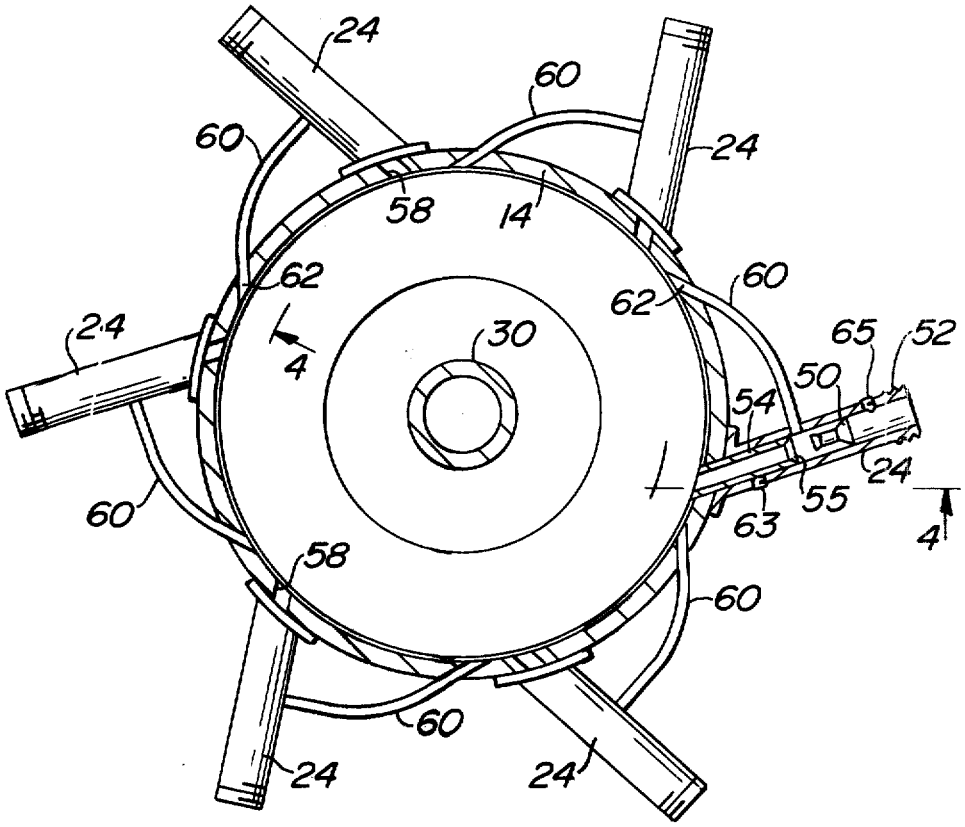
FIG. 2 is a sectional view of the mill illustrated in FIG. 1 taken along the line 2—2.

As best shown in FIG. 2, each of a plurality of tubular sleeves 24 align gaseous pressure nozzles 50 with acceleration tubes 54. The sleeves are spaced around the entirety of peripheral wall 14 and positioned at an angle to the radius of chamber 12 so that gas and material emitted from acceleration tubes 54 flow with both a forward and a radial component of direction. Thus, the nozzles and acceleration tubes create and maintain a circulating vortex within the chamber 12. Each of the nozzles 50 is connected to an annular manifold (not shown) which is supplied with a source of gaseous fluid (e.g., compressed air or steam) under pressure.

An outlet duct 30 for comminuted material extends through the wall 18 and is preferably coaxial with the axis of the chamber 12.

Preferably, material feed is accomplished by providing the lateral wall 16 with a central recess 32 which as shown is frustoconical in shape. The larger diameter of the recess is coplanar with the lateral wall 16 and its smaller diameter is remote from it as shown. The smaller diameter or apex of the recess 32 opens into the feed chamber 34 which includes cylindrical wall 36 and is closed by end wall 38. Chamber 34 should have a circular cross-section or otherwise be in the form of a regular surface of revolution. Moreover, the axis of the wall 36 is preferably coaxial with the axis of the recess 32.

Figure 3:
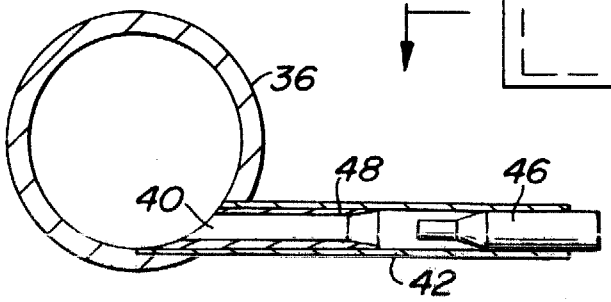
FIG. 3 is a sectional view of the mill illustrated in FIG. 1 taken along the line 3—3.

At best illustrated in FIGS. 1 and 3, the chamber 34 is provided with an inlet 40 which extends through the wall 36 in such a manner that material fed through the feed duct 42 flows into the chamber 34 tangential with the wall 36. The feed material is inserted into the apparatus 10 through the funnel 44 and is entrained by the gaseous carrier fluid exiting from the nozzle 46 which injects the material into the venturi passage 48 where it is accelerated and propelled through inlet 40 into the chamber 34. The nozzle 46 is connected to a source of carrier fluid under pressure (not shown).

The diameter of the feed chamber 34 is of sufficient dimension in relation to the total amount of gaseous carrier fluid and material tangentially directed into it so that it will enter the apex of the recess 32 with a greater rotational direction than upward thrust. By way of example, but not limitation, it has been determined that in most applications an axial length equal to the diameter of the feed chamber 34 is satisfactory. Further, the diameter must be considered in relation to the recess 32. In this regard, satisfactory results are obtained when the diameter of the feed chamber 34 is approximately one-half (½) of the large diameter of recess 32.

The carrier fluid and entrained feed material are constrained by wall 36 to whirl around within feed chamber 34. the material and carrier fluid also move axially with a high velocity helical action toward and into recess 32 where it transfers its rotary energy to the classifying vortex of the apparatus itself. In this manner, the carrier gas and entrained material add energy to the circulating vortex in the classifying zone. As pointed out in U.S. Pat. No. 4,018,388, the rotary velocity of the circulating load within chamber 12 exceeds the velocity of the circulating load adjacent the inner periphery of the wall 14. Moreover, the axial introduction of the material into the apex of the recess, centrally located in relation to the periphery of the apparatus, permits the material to be dispersed radially and axially resulting in a more uniform distribution of the feed material into the classification zone.

For a more detailed explanation of the operation of the material feed means illustrated and described above, reference is made to U.S. patent application Ser. No. 904,665 filed May 10, 1978 for Comminuting and Classifying Apparatus of the Re-entrant Circulating Stream Jet Type, now U.S. Pat. No. 4,189,102.

As best shown in FIGS. 1 and 2, tubular sleeves 24 are uniformly spaced about the periphery of the wall 14. Each tubular sleeve 24 contains a nozzle 50 which may be of the converging-diverging type for generating a high velocity jet stream of gaseous fluid. The fluid most commonly used in re-entrant circulating stream mills such as Micronizers is either compressed air or superheated steam which is connected to the inlet of nozzle 50 by means of a conventional manifold (not shown) coupled to threads 52. The sleeves 24 also include an accelerating tube 54 which has a tapered throat or entrance 55 opening to an otherwise uniform cross-section throughout its length. Both nozzle 50 and acceleration tube 54 are held in axial alignment by the uniform bore of sleeve 24 and are also held properly spaced from each other by set screws 63 and 65. The exit end of acceleration tube 54 is positioned flush with the inner periphery of wall 14 so that gaseous fluid flows from nozzle 50 through acceleration tube 54 into the vortex chamber 12 where it circulates about in a vortex which flows inwardly at high rotative velocity. The angulation of acceleration tube 54 with respect to the radius of chamber 12 produces this effect.

A transfer tube 60 provides open direct communication between a vent operating 62 in the peripheral wall 14 and the junction between the exit end of nozzle 50 and the entrance to acceleration tube 54. Each of the vent openings 62 in wall 14 is at an angle to the radius of chamber 12 so that the gases and entrained material circulating in a clockwise direction as viewed in FIG. 2 more readily enter the transfer tube 60.

In the operation of the mill 10, gas and material circulating within the chamber 12 are aspirated through transfer tube 60 by the suction created by the high velocity of the gas issuing from nozzle 50 into acceleration tube 54. Thus, the pressure at the junction between nozzle 50 and the entrance to acceleration tube 54 is lower than the peripheral pressure within the chamber 12. Accordingly, a significant percentage of the particles of heavier material flowing adjacent the peripheral wall 12 are drawn into the acceleration tube 54 by the gaseous jet stream issuing from the nozzle 50. The material then becomes entrained in the gaseous jet stream within the acceleration tube 54 and is discharged into the chamber 12 at an angle to the direction of flow of the remainder of the material within the chamber.

Within each set of nozzle 50 and acceleration tube 54, the material which is to be directed at an angle to the whirling gases is first aspirated into a high velocity gaseous jet stream and accelerated to its maximum velocity before entering the chamber. Thus, no radial distance within the chamber is used for accelerating the material. In other words, the jet stream can be loaded to its maximum effective material carrying capacity regardless of the type of nozzle used to create the jet stream or the pressure of the jet stream before exiting from the peripheral wall 14 into the chamber 12.

It is important that each of the acceleration tubes 54 have substantial length. The reason for this can be likened to the longer barrel of a rifle as compared to a pistol and for the same reason increases the exit velocity of the gas and material. For this reason, longer acceleration tubes 54 are used when converging-diverging nozzles or nozzles of extremely high pressure are used. This permits controlled expansion and a longer time to effectively engage the material and accelerate it to its maximum velocity upon exit from the acceleration tube and impact with the circulating material. Because of this, no radial distance within the chamber is used to accelerate the material. Moreover, another collateral benefit results from using the longer acceleration tubes of the present invention. In particular, a comminuting effect upon the material takes place within each acceleration tube 54.

It should be noted, however, that this comminuting effect is known as reported in the 4th Edition of Perry's Chemical Engineering Handbook, Chapter 8, page 43 under the heading "Flash Pulverizing" wherein the results of tests done in 1945 by the staff of the Institute of Gas Technology is stated as follows:

> "It was found that a wide variety of friable materials . . . could be pulverized for introducing them into a stream of gas at moderate pressure and causing the streaming entrainment to pass through the nozzle or orifice into a zone of lower pressure. Originally conceived as a continuing explosive process, it was later demonstrated that the size reduction was actually accomplished by impact of the particles as they pass at high velocity and in very turbulent flow through the nozzle."

A very important benefit of the invention is that the area of discharge through the peripheral wall 14 can be in the neighborhood of four times that of the cross-sectional area of conventional nozzles. Because of this greater area, there is a much increased initial contact with the most concentrated portion of the circulating stream of fluid and material. Still further, these particles have already been accelerated to their maximum velocity when they impact the circulating material which is not the case in previous Micronizer type mills.

Tests have been conducted on recirculating stream mills constructed in accordance with the present invention with the following results. The mill produces up to forty percent more material in the ten to fifteen micron range using the same amount of energy as a conventional mill when grinding toner powders for photocopiers. In a like manner, the mill produces up to twenty-five percent more material in the ten to fifteen micron range when grinding various types of plastics. The disadvantage of the mill 10 is that it does not produce as fine a product as can be obtained in a conventional Micronizer. The reason for this can be understood by consideration of the so-called tangent circle which is formed by the gaseous streams issuing from the acceleration tube 54 and is described in column 1 of U.S. Pat. No. 4,018,388. The tangent circle is the zone of highest velocity and represents the major classifying zone of the mill. The operation of a mill in accordance with the present invention calls for more pulverizing work to be done on the material than in conventional Micronizers. Thus, energy expended in pulverizing the material is not available for maintaining the circulating stream at the tangent circle. Hence, it will rotate at a lower velocity and not be quite as effective a classifier.

However, some increase in the fineness of the product can be obtained by alternating the nozzle 50 and acceleration tube set 54 with conventional tubular nozzles in the peripheral wall 14. Thus, the mill 10 will still provide the benefit of greater production with a fineness of product closer to that produced by conventional Micronizers. However, the mill 10 will not produce product of the same fineness because the supply of material to the nozzle sets 24 increases the load on the jet streams thereby necessarily resulting in a reduction of the velocity of the circulating stream at the tangent circle.

Fineness of product can be somewhat increased by reducing the cross-sectional area of the transfer tube 60 so that less material is supplied to each nozzle 50 and acceleration tube set 54. This helps increase the velocity of the circulating stream at the tangent circle, but still does not produce as fine a product as in a conventional Micronizer.

It must be noted that the size of the transfer means has an important effect on the operation of the mill 10. The vent openings 62 and tubes 60 must be kept at a small cross-sectional area so that there can be a free and rapid flow of material laden gas from the circulating stream through the transfer tube 60 into the junction of nozzle 50 and acceleration tube 54. Too large a cross-sectional area for a vent opening 62 and tube 60 will result in plugging up the entrance to acceleration tube 54 with material, thereby destroying the operation of the device.

This can be understood by reference to the operation of jet-venturi feed assemblies used with conventional re-entrant circulating stream mills. In the operation of that type of feed assembly, it is essential that there be a constant flow of air with the material being supplied to the venturi in order to accelerate the material as it approaches the venturi. If material is supplied from the funnel even temporarily at a rate greater than the jet-venturi can handle, there is a consequent shut off the air flow and the material will simply back up in the funnel and overflow. Shutting off the feed will not normally cure this.

In the operation of a mill constructed in accordance with the present invention, material is supplied through the transfer tube 60 at a rate many times that which could be obtained by gravity feed in a venture feed assembly. Therefore, unless the cross-sectional area of the vent 62 and transfer tube 60 is small, the material would behave in a manner equivalent to excess feeding.

Although there is some latitude in the following dimensions, and although the dimensions will vary depending upon the size of the mill, the material being ground and the size of the nozzles 50 and acceleration tubes 54, the following example is given to exemplify dimensions and thereby provide a basis upon which other dimensions can be readily established. In particular, it has been determined that the results stated above can be obtained using a mill 10 in which the inner diameter of the peripheral wall 14 is 20 inches and its height is one and one-half (1½) inches. The mill is operated with eight converging-diverging nozzles 50 in which the smallest diameter of each nozzle 50 is one-quarter (¼) inch and the diameter of each acceleration tube 54 is five-eighths (⅝) inch. The inner diameter of each transfer tube is five-eighths (⅝) inch and the diameter of the vents 62 is seven-sixteenths (7/16) inch. The length of the acceleration tube is six (6) inches.

Figure 4:
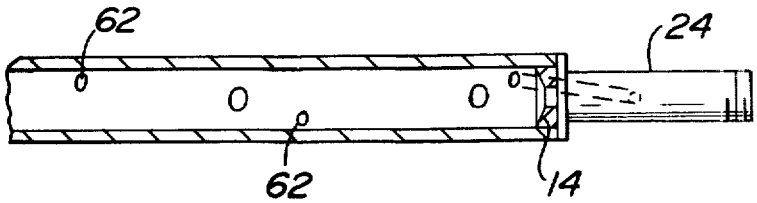
FIG. 4 is a partial sectional view of the mill illustrated in FIG. 2 taken along the line 4—4.

In the mill 10, the acceleration tubes 54 are positioned equidistant from the top and bottom of the peripheral wall 14 with the vents 62 being alternated from top to bottom as illustrated in FIG. 4. However, it may also be advantageous to place all of the vents 62 close to the top of the wall 14 and the nozzle 54 closer to the bottom than the top because of the tendency of material to concentrate in a plane removed from the plane of the jets nearer the bottom.

As indicated above, the mill 10 is preferably fed in the manner described in co-pending patent application Ser. No. 904,665 filed May 10, 1978, now U.S. Pat. No. 4,189,102, or as in U.S. Pat. No. 4,018,388. Both feeding means introduce material in the region of lowest pressure. This permits an increase in the energy supplied to the mill thereby increasing the velocity of the circulating stream as well as the pressure adjacent the peripheral wall 14. Conventional peripheral feeding apparatus would be impractical at such velocities and pressure.

In general, the vents 62 should be located in the peripheral wall 14 at a location axially spaced from the openings 58 through which the gaseous jet streams are discharged. It is known from a study of peripheral wear patterns that material tends to circulate in the plane most axially removed from the plane of the gaseous jets. For this reason, large mills usually position the nozzles slightly closer to the bottom than the top of the annular wall. This permits materials circulating in the upper corner to be slowed by friction and work its way down to the gaseous jets. If the gaseous jets are closer to the top, material will circulate below them and build up until it becomes a burden on the circulating gases and the mill becomes inefficient to operate. Thus, the lateral positioning of the vents 62 reduces the amount of material that can circulate against the peripheral wall at a location removed from the gaseous jets.

Figure 5:
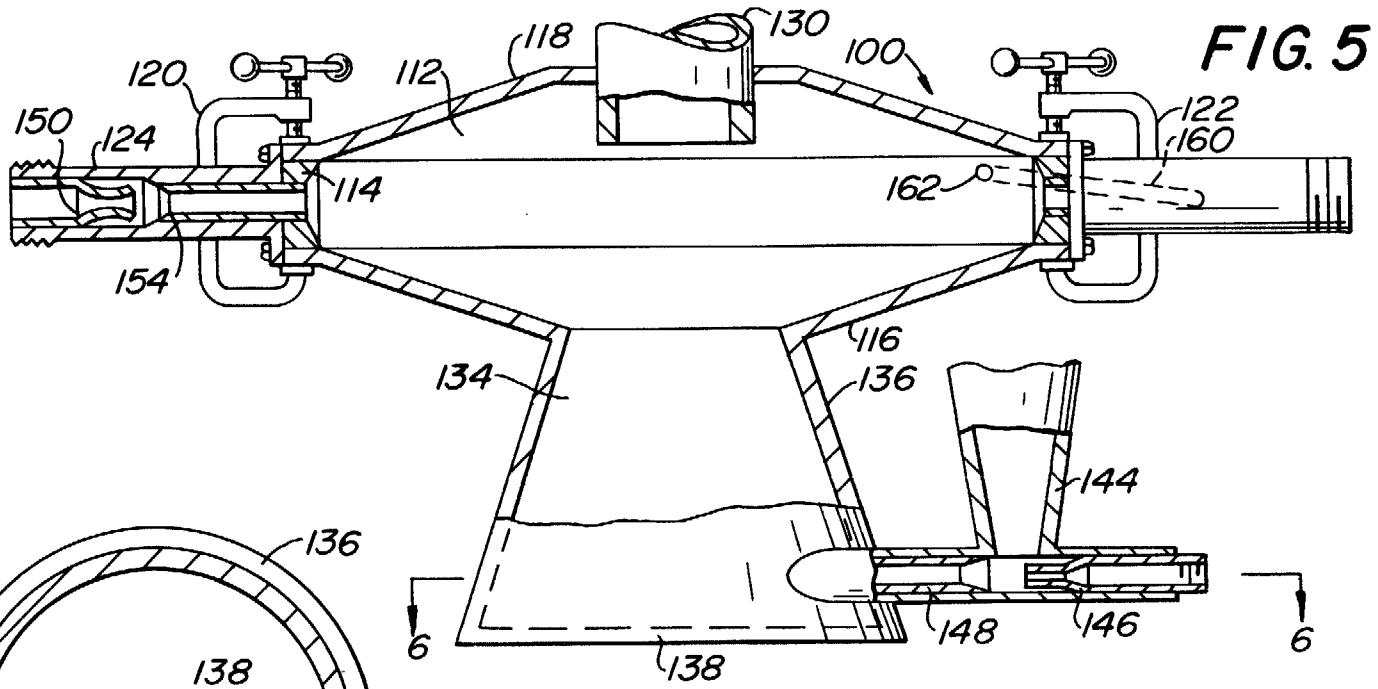
FIG. 5 is a sectional view of an alternative embodiment of the present invention.
Figure 6:
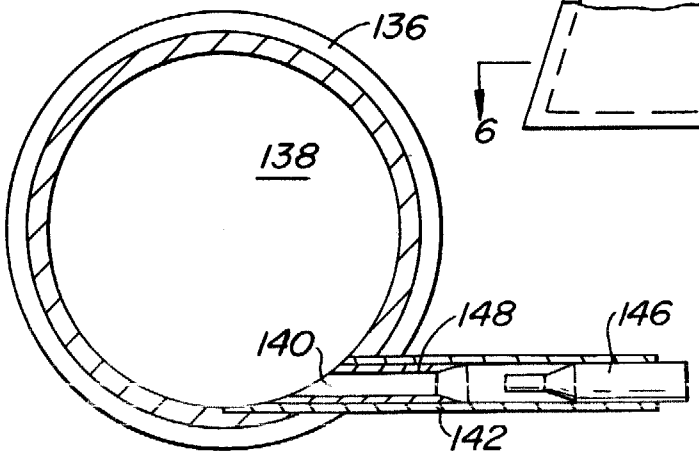
FIG. 6 is a sectional view of the mill illustrated in FIG. 5 taken along the line 6—6.

Referring now to FIGS. 5 and 6, there is shown a comminuting mill 100 embodying an alternative form of the present invention. As shown, the comminuting mill 100 is of the re-entrant circulating stream type and includes a circular vortex chamber 112 defined by the annular peripheral wall 114 and the opposed lateral walls 116 and 118. Walls 116 and 118 are concave as viewed from inside of the mill in that they are spaced farther apart at the central axis of the mill than they are adjacent to the annular peripheral wall 114. A vortex chamber shaped as illustrated in FIG. 5 is desirable for comminuting light, fluffy materials such as talc, and vortex chambers of this shape have heretofore been used for this purpose. The walls 114, 116 and 118 are removably held together by the C-clamps 120 and 122 so that the mill 110 can be readily disassembled and cleaned.

Each of a plurality of tubular sleeves 124 align gaseous pressure nozzles 150 with acceleration tubes 154. The sleeves are spaced around the entirety of peripheral wall 114 and positioned at an angle to the radius of chamber 112 so that gas and material emitted from acceleration tubes 114 flow with both a forward and radial component of direction. Thus, the nozzles and acceleration tubes create and maintain a circulating vortex within the chamber 112. Each of the nozzles 150 is connected to an annular manifold (not shown) which is supplied with a source of gaseous fluid (e.g., compressed gas or steam) under pressure.

An outlet duct 130 for comminuted material extends through the wall 118 and is preferably coaxial with the axis of the chamber 112.

The mill 100 can be fed conventionally by introducing material through the wall 118. However, it is preferably fed by providing a feed chamber 134 which comprises a frusto-conical wall 136 and end wall 138. Conical wall 136 opens directly into vortex chamber 112 and it is preferably coaxial with the central axis of chamber 112.

Referring to both FIGS. 5 and 6, the feed chamber 134 is provided with an inlet 140 which extends through the wall 136 in such a manner that material fed through the feed duct 142 flows into the chamber 134 tangentially with the wall 136. The feed material is inserted into the mill 100 through funnel 144 and is entrained by a gaseous carrier fluid exiting from nozzle 146 which injects the material into the venturi passage 148 where it is accelerated and propelled through inlet 140 into the chamber 134. The nozzle 146 is connected with source of carrier fluid under pressure (not shown).

The maximum diameter of the feed chamber 134 is of sufficient dimension in relation to the total amount of gaseous carrier fluid and material tangentially directed into it so that it will enter the vortex chamber 112 with a greater rotational direction than upward thrust. The conical shape of wall 136 makes certain that the material has substantially more rotational velocity than axial velocity when it enters the chamber 112.

In general, the mill 100 operates in substantially the same manner as the mill 10 using the nozzles 150, acceleration tubes 154 and transfer tubes 160 in the same manner as the counterparts 50, 54 and 60 illustrated in FIGS. 1, 2 and 4. Accordingly, further detailed explanation of the operation of the mill illustrated in FIGS. 5 and 6 is not required. Rather, reference can be had to earlier parts of this specification describing the operation of the mill 10 as illustrated in FIGS. 1-4. It should be sufficient to note that the mill 100 differs from the mill 10 specifically in that it does not include a conical recess 32 and the feed chamber is frusto-conical rather than cylindrical. The lateral walls 116 and 118 are concave but could be planar.

BRIEF DESCRIPTION OF THE PRIOR ART

In accordance with the present invention, material in a re-entrant circulating stream mill is removed directly to a nozzle arrangement and discharged from the annular peripheral wall at an increased velocity. In order to better understand the invention, reference is made to certain prior art devices which are discussed below.

Reference is made to U.S. Pat. No. 2,032,827, FIGS. 3 and 4, with the most pertinent written disclosure appearing on page 7, first column, lines 35-57 and second column, lines 40-67, as well as page 10, second column, lines 43-52. A mill such as is shown and described was constructed with a smooth surface 28-inch diameter annular peripheral wall. Many tests over several months were conducted on barytes, talcum, limestone and other materials. The product put out by the mill was impressive, but its operation was erractic. The mill would run smoothly for awhile and then shake violently, discharging totally unacceptable material. Thereafter, the mill would resume smooth operation. The reason for the malfunction is that material would be flushed from chamber 52 into the mill, thereby overloading the circulating stream of gaseous fluid and material. As the patent points out, it is not essential that all material be kept in circulation so long as it does not gather at points where it would re-enter the vortex in undesired concentrations. The reason for the flushing of material is the radial pressure differential in re-entrant circulating stream mills. See U.S. Pat. No. 2,032,827, page 4, second column, lines 46-73. With the pressure at the periphery of the mill being almost twice that at points closer to the center of the mill, the material in the chamber 52 ultimately would be flushed back into the circulating stream of gaseous fluid or material, thereby overloading it.

The greater peripheral pressure is the result of centrifugal force. The pressure may vary slightly during operation of the mill as slight variations in the feed rate or periodic variations in particle size or grindability cause a reduction in the rotating velocity of the circulating stream of gaseous fluid and material. As a result, the pressure in chamber 52 of the mill illustrated in FIGS. 3 and 4 of U.S. Pat. No. 2,032,827 would be greater than the pressure within the boundaries of the annular peripheral wall. As the gas flowed back into the vortex chamber to compensate for the pressure differential, it would carry material from chamber 52 into the circulating stream with a further slowing up of the circulation and a further lowering of the peripheral pressure until so much accumulated material from chamber 52 entered the vortex chamber that the circulating stream would be completely overburdened and its entire load would be discharged as unacceptable product. Many attempts to overcome this problem were made, but use of this type of mill was abandoned when no solution became apparent.

U.S. Pat. No. 2,325,080 purports to show a comminuting mill in which material is pulled into a pressure nozzle. See FIG. 4 and the description at page 7, lines 70-75 bridging over to page 8, lines 1-23. As described in the patent, the operation of the mill is dependent upon a very considerable suction where the passage 98 enters the nozzles 100. A device was constructed in accordance with the teachings of U.S. Pat. No. 2,325,080 and, as expected, when air at various pressures up to 100 lbs. p.s.i. was supplied to the nozzle 100, it blew out through passage 98 thereby making the mill inoperative for this purpose. Not only does a mill in accordance with that particular part of U.S. Pat. No. 2,325,080 not appear to operate at all, the teaching does not appear to be at all applicable in a re-entrant circulating stream mill. U.S. Pat. No. 2,325,080 indicates that the purpose of the construction is to prevent settling of material in dead spaces between nozzles in that type of mill. There are no dead spaces between nozzles in a re-entrant circulating stream mill, and in fact, such mills depend upon the high velocity circulation at the peripheral wall to supply material to the gaseous jet streams.

It is known that even when using jet-venturi injection means with the venturi opening several times the size of the jet, feeding becomes a problem where material that tends to stick to metal surfaces being fed to the feed funnel. See U.S. Pat. No. 2,596,088, column 1, lines 23-29. Even if there is a very considerable suction where suction connection 98 enters nozzle 100, it is absurd to believe that the tiny nozzle 100 could suck in large quantities of any material, especially those that tend to stick to the walls of passages, alter its direction and not immediately plug up. Thus, the particular apparatus disclosed in U.S. Pat. No. 2,325,080 appears to be both technically and operationally unsound.

The problem is that diverging walls will not transduce pressure into velocity while still providing a suction. See Perry's Chemical Engineering Handbook, Chapter 5, page 31, first column, lines 3–9, 4th Edition. See also Marks Engineering Handbook, Section 4, Flow Through Converging Diverging Nozzles, page 63, lines 6–8, 6th Edition.

U.S. Pat No. 3,688,991 illustrates several embodiments in which material is removed from and reintroduced into the grinding chamber by a nozzle-venturi arrangement. Mills similar to what is illustrated in FIG. 7 have been manufactured in a variety of sizes and operate with considerable satisfaction by causing the reinjected material to impact against a multiplicity of rotating anvils. However, that apparatus differs from the present invention in that it is in actuality two comminuting apparatus in a single casing. In one plane, there is a Micronizer and in the other plane there is a jet and anvil grinding operation.

In U.S. Pat. No. 2,590,220, FIGS. 18 and 19, material is extracted from and reintroduced into the mill for two different purposes. As explained in column 11, lines 32–50, the apparatus illustrated in FIG. 18 performs this function to free the mill of unwanted circulating waste material. This function is accomplished by terminating the feeding of new materials to the mill for a sufficient time to permit the bulk of the waste material to be comminuted and exhausted from the mill. Under the conditions described in U.S. Pat. No. 2,590,220, only a negligible amount of material is returned to the mill through ducts 256–260 and this consists of the extreme fines in the vented material.

The apparatus illustrated in FIG. 19 of U.S. Pat. No. 2,590,220 is solely for the purpose of increasing a circulating load in the mill. See column 11, lines 1–6. Moreover, the place of return is at an area of negative pressure with respect to the mill.

Thus, none of the prior mills vents material from the circulating stream directly to the junction between a pressure nozzle and an acceleration tube and then immediately returns the material to the circulating stream at an increased velocity.

The present invention may be embodied in other specific forms without departing from the spirit or essential attributes thereof and, accordingly, reference should be made to the appended claims, rather than to the foregoing specification, as indicating the scope of the invention.

I claim:

1. Apparatus for comminuting material to a finely divided form, comprising:

a re-entrant circulating stream comminuting mill, said comminuting mill including a chamber having a generally annular peripheral wall, a plurality of spaced gaseous fluid means for discharging gaseous fluid streams through said wall into said chamber with both a component of movement forward in the direction of circulation and a radial component of movement relative to a central axis of said peripheral wall to form a circulating vortex in said chamber, said gaseous fluid means comprising, in tandem, a gaseous pressure nozzle for accelerating the gaseous fluid, and acceleration tube means for directing the accelerated gaseous fluid into said chamber.

transfer means for transferring circulating fluid and entrained material from said chamber directly to each junction of said pressure nozzle and acceleration tube means whereby said circulating fluid and entrained material are drawn to said junction by the difference in pressure between said junction and the chamber and is thereafter accelerated within said acceleration tube means and projected back into said chamber, and material feed means and material outlet means for said mill.

2. Apparatus for comminuting material to a finely divided form in accordance with claim 1 wherein said pressure nozzle is a converging-diverging nozzle.

3. Apparatus for comminuting material to a finely divided form in accordance with claim 1 wherein said transfer means is a tube having one end opening into said chamber through said peripheral wall and the other end connected to the junction between said pressure nozzle and said acceleration tube means.

4. Apparatus for comminuting material to a finely divided form in accordance with claim 3 wherein the ends of said tubular transfer means which open into said chamber are axially displaced on said peripheral wall from the position where said acceleration tube means discharge fluid into said chamber.

5. Apparatus in accordance with claim 1 wherein said acceleration tube is of sufficient length to accelerate said material to its maximum velocity before it re-enters the chamber.

6. Apparatus in accordance with claim 5 wherein said acceleration tube is substantially larger than its diameter.

7. Apparatus in accordance with claim 1 wherein said material feed means comprises a feed chamber closed at one end and opening into the vortex chamber at its other end, said feed chamber including a frusto-conical wall with the smaller diameter end of said wall opening into said vortex chamber, material inlet means for said feed chamber positioned to propel gaseous fluid and material in said feed chamber generally tangential to the wall of said feed chamber so that the material and its carrier fluid flow in the manner of a vortex within said feed chamber and are added to the fluid vortex in said vortex chamber with the principal direction of flow in the same direction as the flow of fluid and material within the vortex chamber, and means to connect said material inlet to a source of material.

8. In an apparatus for comminuting material to a finely divided form, comprising:

a re-entrant circulating stream comminuting mill, said comminuting mill including a chamber having a generally annular peripheral wall, a plurality of spaced gaseous fluid means for discharging a stream of gaseous fluid through said wall into said chamber with both a component of movement forward in the direction of circulation and a radial component of movement relative to a central axis of said wall to form a circulating vortex in said chamber, material feed means and material outlet means for said mill, the improvement being wherein at least a plurality of said gaseous fluid means each comprise, in tandem, a pressure nozzle for accelerating gaseous fluid and acceleration tube means for directing accelerated gaseous fluid into said chamber, and transfer means for transferring circulating fluid and entrained material directly from said chamber to each junction of said pressure nozzle and acceleration tube means, whereby said circulating fluid and entrained material are drawn to said junction by the difference in pressure at said junction and the chamber and thereafter accelerated within said acceleration tube and projected back into said chamber.

9. In an apparatus for comminuting material in accordance with claim 8 wherein said transfer means is a tube having one end opening into said chamber through said annular peripheral wall and the other end connected to the junction between said pressure nozzle and said acceleration tube means.

10. Apparatus for comminuting material in accordance with claims 3 or 9 wherein said transfer tube opens into said chamber through said peripheral wall at an angle opposed to the direction of circulation so that fluid and material readily enter the transfer tube.

11. Apparatus for comminuting material to a finely divided form in accordance with claims 1 or 8 wherein said chamber includes opposed concave lateral walls.

12. A process for comminuting material to a finely divided form, comprising:

generating a circulating gaseous stream within a closed annular chamber using a plurality of spaced gaseous fluid means for discharging streams of gaseous fluid through said wall into said chamber with both a component of movement forward in the direction of circulation and a radial component of movement relative to a central axis of said chamber to form a circulating vortex in said chamber, generating said stream of gaseous fluid by generating a high velocity gaseous jet in a pressure nozzle and then passing the jet stream through an acceleration tube into said chamber, feeding material to be comminuted into said chamber, transferring circulating fluid material from the chamber to the junction of said pressure nozzle and said acceleration tube, and then accelerating said material within said acceleration tube and projecting it back into said chamber, and withdrawing finished material from said chamber.

13. A process for comminuting material to a finely divided form in accordance with claim 12 wherein said material is withdrawn from said chamber adjacent the periphery thereof and transferred directly to the junction between said pressure nozzle and said acceleration tube.

14. A process for comminuting material to a finely divided form in accordance with claim 12 wherein the material is accelerated to its maximum velocity within said acceleration tube before reentering the chamber.

* * * * *